United States Patent [19]

Grosboll

[11] Patent Number: 4,483,762

[45] Date of Patent: Nov. 20, 1984

[54] HYDROCARBON CONVERSION PROCESS USING MOLYBDENUM CATALYST

[75] Inventor: Martin P. Grosboll, Mokena, Ill.

[73] Assignee: Atlantic Richfield Company, Philadelphia, Pa.

[21] Appl. No.: 511,619

[22] Filed: Jul. 7, 1983

[51] Int. Cl.[3] ..... C10G 45/04; C10G 47/12; C10G 47/14

[52] U.S. Cl. ..... 208/108; 208/216 R; 208/251 H; 208/254 H; 260/429 R

[58] Field of Search ..... 208/108, 112, 216 R, 208/251 H, 254 H; 260/429 R

[56] References Cited

U.S. PATENT DOCUMENTS

| | | | |
|---|---|---|---|
| 3,591,486 | 7/1971 | Peck et al. | 208/85 |
| 4,125,455 | 11/1978 | Herbstman | 208/108 |
| 4,192,735 | 3/1980 | Aldridge et al. | 208/112 |
| 4,285,804 | 8/1981 | Jacquin et al. | 208/48 R |
| 4,357,229 | 11/1982 | Bearden, Jr. et al. | 208/10 |

*Primary Examiner*—Delbert E. Gantz
*Assistant Examiner*—O. Chaudhuri
*Attorney, Agent, or Firm*—Donald L. Traut

[57] ABSTRACT

A hydrocarbon hydroconversion process is disclosed which comprises:

combining the chargestock and a minor, effective amount of at least one molybdenum compound prepared by a method which comprises interacting molybdenum metal with at least one peroxy compound in the presence of at least one saturated alcohol having from one to four carbon atoms per molecule to solubilize at least a portion of the molybdenum metal;

contacting the molybdenum compound within the chargestock in the presence of a gas selected from the group consisting of a hydrogen-containing gas, a hydrogen sulfide-containing gas, and a gas comprising hydrogen and hydrogen sulfide, at conditions to produce a solid catalyst within the chargestock capable of promoting the hydroconversion of at least a portion of the chargestock;

contacting the chargestock containing the catalyst with hydrogen under hydroconversion conditions to hydroconvert at least a portion of the chargestock; and recovering a hydroconverted hydrocarbon product.

17 Claims, No Drawings

HYDROCARBON CONVERSION PROCESS USING MOLYBDENUM CATALYST

This invention relates to a process for the hydroconversion of hydrocarbon fractions. More particularly, the invention relates to such hydroconversion in the presence of one or more of a select group of molybdenum-containing catalysts to achieve improved results.

U.S. Pat. No. 4,192,735 (and related patents) teaches that minor amounts of an oil soluble compound of metals of Group IVB, VB, VIB, VIIB, and VIII of the Periodic Table of elements and their conversion products act as catalysts for the hydroconversion of hydrocarbonaceous oils. This patent teaches a preference for oil soluble metal compounds of molybdenum, more preferably molybdenum naphthenate.

Improvements in this catalytic system would be beneficial. For example, increased catalyst activity and/or selectivity would reduce equipment sizes and/or produce more desired and valuable products.

U.S. Pat. No. 3,816,301 teaches an improved process for preferentially oxidizing the sulfur in a hydrocarbon material in the presence of a certain class of molybdenum-containing catalysts to produce hydrocarbon products having reduced sulfur content. While this oxidation process is effective, it is substantially different from the hydroconversion process of the present invention.

One object of the present invention is to provide an improved hydroconversion process for hydrocarbon chargestocks.

Another object of the invention is to provide an improved catalyst system for the hydroconversion of hydrocarbon chargestocks. Other objects and advantages of the present invention will become apparent hereinafter.

An improved process has now been discovered for the hydroconversion, preferably hydrocracking, of a substantially hydrocarbon chargestock. In one embodiment, this process comprises (a) combining the chargestock and a minor, effective amount of at least one molybdenum compound prepared by a method which comprises interacting molybdenum metal with at least one peroxy compound in the presence of at least one saturated alcohol having from one to four carbon atoms per molecule to solubilize at least a portion of the molybdenum metal;

(b) contacting the molybdenum compound within the chargestock in the presence of a gas selected from the group consisting of a hydrogen-containing gas, a hydrogen sulfide-containing gas, and a gas comprising hydrogen and hydrogen sulfide, at conditions to produce a solid catalyst within the chargestock capable of promoting the hydroconversion of at least a portion of the chargestock;

(c) contacting the chargestock containing the catalyst with hydrogen under hydroconversion conditions to hydroconvert at least a portion of the chargestock; and (d) recovering a hydroconverted substantially hydrocarbon product.

The term "hydroconversion" is used herein to designate a catalytic process conducted in the presence of hydrogen in which at least a portion of a hydrocarbon fraction (chargestock), e.g., the heavy or high boiling constituents and coke precursors (as mesured by Conradson carbon residue) of the hydrocarbon fraction, is converted to lower boiling hydrocarbon products while simultaneously reducing the concentration of at least one of, preferably all of, nitrogenous compounds, sulfur compounds and metallic contaminants.

In preparing the molybdenum-containing catalysts useful in the present invention, metallic molybdenum is interacted, i.e., co-mingled or contacted, with at least one peroxy compound, e.g., organic hydroperoxide, organic peroxide, organic peracid, hydrogen peroxide and mixtures thereof, in the presence of at least one low molecular weight saturated alcohol, either mono- or poly-hydroxy, containing from one to four carbon atoms per molecule to solubilize at least a portion of the molybdenum metal. It is believed that the molybdenum metal reacts with the peroxy compound to form a compound or complex which is soluble in the saturated alcohol and remaining peroxy compound.

Typical peroxides, hydroperoxides and peracids useful in the preparation of the molybdenum-containing catalyst include, by way of example, hydrocarbon peroxides, hydrocarbon hydroperoxides and hydrocarbon peracids wherein the hydrocarbon radicals in general contain up to about 20 carbon atoms per active oxygen atom. With respect to the hydrocarbon peroxides and the hydrocarbon hydroperoxides, it is particularly preferred that such hydrocarbon radical contain from about four to about 18 carbon atoms per active oxygen atom and more particularly from four to 10 carbon atoms per active oxygen atom. With respect to the hydrocarbon peracids, the hydrocarbon radical is defined as that radical which is attached to the carbonyl carbon and it is preferred that such hydrocarbon radical contain from one to about 12 carbon atoms, more preferably from one to about eight carbon atoms, per active oxygen atom. It is intended that the term organic peracid include, by way of definition, performic acid.

Typical examples of hydrocarbon radicals are alkyls such as methyl, ethyl, butyl, t-butyl, pentyl, n-octyl and those aliphatic radicals which represent the hydrocarbon portion of a middle distillate of kerosene, and the like; cycloalkyl radicals such as mono- and polymethylcyclo-pentyl radicals and the like; aryl radicals such as phenyl, naphthyl and the like; cycloalkyl substituted alkyl radicals such as cyclohexyl methyl and ethyl radicals and the like; alkyl phenyl substituted alkyl radicals examples of which are benzyl, methyl-benzyl, caprylbenzyl, phenylethyl, phenylpropyl, naphthylmethyl, naphthylethyl and the like; alkaryl radicals such as xylyl, methylphenyl and ethylphenyl and the like radicals.

Typical examples of peroxy compounds are hydroxyheptyl peroxide, cyclohexanone peroxide, tertiary butyl peracetate, di-tertiary butyl diperphthalate, tertiary butyl perbenzoate methyl ethyl ketone peroxide, dicumyl peroxide, tertiary butyl hydroperoxide, di-tertiary butyl peroxide, p-methane hydroperoxide, pinane hydroperoxide, 2,5-dimethylhexane-2,5-dihydroperoxide, cumene hydroperoxide and the like; as well as organic peracids such as performic acid, peracetic acid, trichloroperacetic acid, per-benzoic acid, perphthalic acid and the like.

In order to obtain the maximum benefits of the present invention, the most preferred peroxy compound for use in the present invention is tertiary butyl hydroperoxide.

These peroxy compounds may also be substituted with groups such as halides, $—NH_2$, —SH,

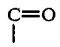

and the like, which do not substantially interfere with the catalyst forming process.

Hydrogen peroxide suitable for preparing the molybdenum-containing catalyst is preferably used in the form of an aqueous solution containing, for example, from about 10% to about 60%, preferably about 30 percent, by weight of hydrogen peroxide.

Typical examples of low molecular weight monohydroxy alcohols which are suitable for use in the preparation of the present molybdenum-containing catalyst include methyl alcohol, ethyl alcohol, isopropyl alcohol, n-butyl alcohol, tertiary butyl alcohol and the like. The low molecular weight polyhydroxy alcohols which are suitable include ethylene glycol, propylene glycol, 1,2-butyl glycol and glycerol. In general, either mono- or poly-hydroxy alcohols containing from one to four carbon atoms per molecule are suitable. Although the presence of the lower alcohols, e.g., methyl alcohol and ethyl alcohol, produces a faster solubilization of molybdenum, in order to maximize the benefit of the overall process of the present invention it is preferred that the molybdenum metal be interacted with tertiary butyl hydroperoxide in the presence of tertiary butyl alcohol. If tertiary butyl alcohol is used as the saturated alcohol, it is preferred, to enhance molybdenum solubility, that the interaction mixture comprise additionally at least one mono- or poly-hydroxy alcohol having from one to about 16 carbon atoms per molecule, and at least one primary hydroxy group, and be present in an amount of from about 1 to about 25 percent by weight of the total alcohol present. A particularly preferred alcohol mixture for use in combination with tertiary butyl alcohol is a stream of higher poly-hydroxy alcohols having a molecular weight in the range from about 200 to about 300 and containing from about 4 to about 6 hydroxy groups derived from propylene epoxidation and described in U.S. Pat. No. 3,573,226.

The relative proportions of peroxy compound and low molecular weight saturated alcohol employed in preparing the catalyst may vary over a broad range and are, therefore, not of critical importance to the invention. Typically, the peroxy compound comprises from about 5 to about 50 percent by weight of the total peroxy compound and saturated low molecular weight alcohol used in catalyst preparation.

The molybdenum concentration in the catalyst mixture, i.e., the mixture comprising the dissolved or soluble molybdenum plus any excess peroxy compound and alcohol, often is within the range of about 15 ppm. to about 5 percent, perferably in the range of about 1,000 ppm. to about 2 percent by weight of the total mixture. It may be desirable to prepare the catalyst in the presence of a solvent such as benzene, ethyl acetate and the like, in order to obtain the optimum molybdenum concentration in the final catalyst mixture. However, if this type of dilution is desired, it is preferred that an excess of tertiary butyl alcohol be maintained in the catalyst mixture for this purpose.

The molybdenum metal useful in the preparation of the present catalyst may be in the form of lumps, sheets, foil or powder. The powdered material, e.g., having a particle size such that it passes through a 50 mesh sieve, preferably through a 200 mesh sieve, on the Standard Screen Scale, is preferred since it offers increased surface area per unit volume and an increased rate of solubilization.

The molybdenum metal-peroxy compound interacting may be carried out at a wide range of temperatures, for example, temperatures within the range from about 25° C. to about 150° C. Interacting pressures should be set to avoid extensive vaporization of the peroxy compound and alcohol. Typical interacting pressures may range from about 1 psia. to about 100 psia. In many instances, atmospheric pressure may be used. After the interacting has been carried out for a desired length of time, e.g., from about 5 minutes to about 300 hours, preferably from about 15 minutes to about 6 hours, the product from the interacting may be filtered to separate the undissolved molybdenum from the catalyst mixture which is thereafter suitable for use as a catalyst for the oxidation of sulfur impurities in hydrocarbon materials.

In one embodiment, the process of the invention is applicable to heavy hydrocarbonaceous oils. Suitable heavy hydrocarbonaceous oil chargestocks include heavy mineral oil; whole or topped petroleum crude oils, including heavy crude oils; polynuclear aromatics such as asphaltenes, residual oils such as petroleum atmospheric distillation tower resids (boiling above 650° F.) and petroleum vacuum distillation tower resids (vacuum residus, boiling above about 1,050° F.); tars, bitumen; tar sand oils, shale oils. The process is particularly well suited to heavy crude oils and residual oils which generally contain a high content of metallic contaminants (nickel, iron, vanadium) usually present in the form of organometallic compounds, e.g., metalloporphyrins, a high content of sulfur compounds, a high content of nitrogenous compounds and a high Conradson carbon residue. The metal content of such oils may range up to 2,000 wppm. or more and the sulfur content may range up to 8 weight percent or more. The API gravity at 60° F. of such feeds may range from about −5° API to about +35° API and the Conradson carbon residue of the heavy feeds will generally be at least about 5 weight percent, preferably in the range of about 5 to about 50 weight percent, more preferably about 10 to about 50 weight percent (as to Conradson carbon residue, see ASTM test D-189-65). Preferably, the feedstock is a heavy hydrocarbon oil having at least 10 weight percent of material boiling above 1,050° F. at atmospheric pressure, more preferably having at least about 25 weight percent of material boiling above 1,050° F. at atmospheric pressure.

In the above embodiment, the molybdenum compound, prepared and described above, is combined with the heavy hydrocarbon chargestock so that the resulting mixture preferably includes about 10 to about 2000 wppm., more preferably about 50 to about 300 wppm., still more preferably about 50 to about 200 wppm. of molybdenum, calculated as elemental metal, based on the heavy hydrocarbon oil chargestock.

In an additional embodiment, the process of the invention is applicable to substantially hydrocarbon chargestock boiling, at atmospheric pressure, in the range of about 430° F. to about 1100° F., preferably in the range of about 500° F. to about 1050° F., more preferably in the range of about 650° F. to 1050° F. These hydrocarbon chargestocks may be derived from any source such as petroleum, oil shale, tar sands, coal liquids. The Conradson carbon residue of these chargestocks will generally range below 5 weight percent, preferably below 2 weight percent. By way of example, suitable hydrocarbon chargestocks for the process of the present invention include virgin gas oil, vacuum gas oil, coker gas oil, petroleum distillates, hydrocarbon oils derived from coal liquefaction processes, etc. and mixtures thereof. Preferably, the chargestock is a mixture of hydrocarbons boiling, at atmospheric pressure, in the range of about 650° L F. to 1050° F. More preferably, the hydrocarbon chargestock is a substantially asphaltene-free oil. By "substantially asphaltene-free" is intended herein that the chargestock comprises less then about 1.0 weight percent asphaltenes.

In this embodiment, the molybdenum compound, prepared as described above, is combined with the hydrocarbon chargestock so that the resulting mixture preferably includes about 10 to about 2000 wppm., more preferably about 50 to about 300 wppm., still more preferably about 50 to about 200 wppm. of molybdenum, calculated as elemental metal, based on the hydrocarbon chargestock.

Various methods can be used to convert the molybdenum compound in the chargestock to a catalyst. One method (pre-treatment method) of forming a catalyst from the molybdenum compound of the present invention is to heat the mixture of the metal compound in the hydrocarbon chargestock to a temperature in the range of about 600° F. to about mole percent, of the hydrogen-containing gas mixture. The thermal treatment in the presence of hydrogen or in the presence of hydrogen and hydrogen sulfide is believed to convert the molybdenum compound to the corresponding catalyst. The resulting catalyst contained within the chargestock is then introduced into a hydroconversion zone which will be subsequently described.

A preferred method of converting the oil-soluble metal compound of the present invention to a catalyst is to react the solution of the compound in oil with a hydrogen-containing gas at hydroconversion conditions to produce the catalyst in the chargestock in situ in the hydroconversion zone. Preferably, the hydrogen-containing gas comprises about 1 to about 10 mole percent, more preferably about 2 to 7 mole percent, hydrogen sulfide. The conversion of the metal compound in the presence of the hydrogen-containing gas or in the presence of the hydrogen and hydrogen sulfide is believed to produce the corresponding molybdenum catalyst.

The hydroconversion zone is preferably maintained at a temperature in the range of about 650° F. to about 1000° F., more preferably 750° F. to about 900° F., and still more preferably about 800° F. to about 875° F., and at a hydrogen partial pressure in the range of about 500 to about 5,000 psig., more preferably about 1,000 to about 3,000 psig. Contact of the chargestock catalyst at hydroconversion conditions in the reaction zone with the hydrogen-containing gas converts the metal compound to the corresponding metal catalyst in situ. The hydroconverted oil, possibly containing solids, is removed from the hydroconversion contacting zone. The solids may be separated from the hydroconverted oil by conventional means, for example, by settling or centrifuging or filtration of the slurry or concentration techniques, such as solvent extraction, vacuum distillation and the like. At least a portion of the separated solids or solids concentrate may be recycled directly to the hydroconversion contacting zone or recycled to be combined with the hydrocarbonaceous oil chargestock, or may be disposed of. The space velocity, defined as volumes of chargestock per hour per volume of reactor (V/hr./V), may vary widely depending on the desired hydroconversion level. Suitable space velocities may range broadly from about 0.1 to 10 volumes of oil feed per hour per volume of reactor, preferably from about 0.25 to 6 V/hr./V, more preferably from about 0.25 to 6 V/hr./V, more preferably from about 0.5 to 2 V/hr./V. The process of the invention may be conducted either as batch or as continuous type operation.

In the preferred hydrocracking embodiment, the hydrocracking zone is preferably maintained at a temperature in the range of about 700° F. to about 1000° F., more preferably about 800° F. to about 900° F., and at a total pressure in the range of about 100 to 5000 psig., more preferably from about 500 to 3000 psig. Hydrogen is introduced into the reaction zone at a rate of about 300 to about 10,000 standard cubic feet per barrel, preferably at a rate of about 1000 to 5000 standard cubic feet per barrel of hydrocarbonaceous oil. Reaction time may vary widely. Suitable reaction times include from about 5 minutes to about 4 hours, preferably from about 10 minutes to 2 hours depending upon the desired degree of conversion.

The following examples illustrate more clearly the process of the present invention. However, these illustrations are not to be interpreted as specific limitations on the invention.

EXAMPLE I

This example illustrates the preparation of the presently useful molybdenum compound.

A soluble, i.e., homogeneous, oxidation catalyst was prepared by combining 0.74 weight percent molybdenum powder with tertiary butyl hydroperoxide in the presence of tertiary butyl alcohol and a mixture of $C_{10}$ to $C_{15}$ glycols containing from 4 to 6 hydroxyl groups per molecule wherein at least one of the hydroxyl groups was primary. The weight ratio of tertiary butyl hydroperoxide to tertiary butyl alcohol to glycols was 2.1:4.1. This combination was heated to reflux temperature with constant stirring and maintained at this temperature until all the molybdenum had dissolved.

EXAMPLE II

This example illustrates the hydrocracking of a heavy hydrocarbonaceous material. The hydrocarbon material employed is a benzene soluble petroleum vacuum still residuum (Initial Boiling Point 610° F., 15 percent overhead—962° F.) having the following composition:

| | Weight % |
|---|---|
| Sulfur | 3.1 |
| Nitrogen | 0.4 |
| Carbon | 85.3 |
| Hydrogen | 10.4 |
| Oxygen | 0.8 |
| Conradson Carbon Content | 20% |

This hydrocarbon material is combined with the molybdenum compound prepared in Example I so that the mixture contains 500 ppm. by weight of molybdenum, calculated as elemental metal. This mixture is contacted with hydrogen at a total pressure of 2500 psig., a temperature of 850° F. and a hydrogen rate of 3000 SCF/B of hydrocarbon for 30 minutes. Hydrocracked products are recovered, e.g., by flashing and distillation. The catalyst is effective to hydrocrack the above-noted hydrocarbon material.

EXAMPLE III

This example illustrates the hydrocracking of a lighter hydrocarbon material. A light Arabian vacuum gas oil feed having a Conradson carbon content of 0.46 weight percent; 2.34 weight percent sulfur and an API gravity of 60° F. of 22.4 was hydrocracked at 840° F. under a total pressure of 2000 to 3900 psig. with a hydrogen charge of 1000 standard cubic feet per barrel of feed. The amount of the molybdenum compound prepared in Example I which is used is 500 ppm. by weight, calculated as elemental molybdenum, based on the hydrocarbon material. Hydrocracked products are recovered from the reaction mixture by conventional means, e.g., flashing and distillation.

The molybdenum compound as set forth above, is shown to be an effective precursor to the catalysts useful in the present invention.

While this invention has been described with respect to various specific examples and embodiments, it is to be understood that the invention is not limited thereto and that it can be variously practiced within the scope of the following claims:

The embodiments of this invention in which an exclusive property or privilege is claimed are defined as follows:

1. A process for hydroconverting a hydrocarbon chargestock comprising:

(a) combining said chargestock and a minor, effective amount of at least one molybdenum compound prepared by a method which comprises interacting molybdenum metal with at least one peroxy compound in the presence of at least one saturated alcohol having from one to four carbon atoms per molecule to solubilize at least a portion of the molybdenum metal;

(b) contacting said molybdenum compound within said chargestock in the presence of a gas selected from the group consisting of a hydrogen-containing gas, a hydrogen sulfide-containing gas, and a gas comprising hydrogen and hydrogen sulfide, at conditions to produce a solid catalyst within said chargestock capable of promoting the hydroconversion of at least a portion of said chargestock;

(c) contacting said chargestock containing said catalyst with hydrogen hydroconversion conditions to hydroconvert at least a portion of said chargestock; and (d) recovering a hydroconverted hydrocarbon product.

2. The process of claim 1 wherein said interacting occurs at a temperature within the range from about 25° C. to about 150° C.

3. The process of claim 2 wherein said molybdenum compound is combined with said chargestock in an amount of at least about 10 ppm. by weight, calculated at elemental metal, based on the hydrocarbon chargestock.

4. The process of claim 1 wherein said hydrocarbon chargestock has a Conradson carbon content of less than about 5 weight percent and said molybdenum compound is combined with said chargestock in an amount of at least about 10 ppm. by weight, calculated as elemental metal, based on the hydrocarbon chargestock.

5. The process of claim 1 wherein said hydrocarbon chargestock has a Conradson carbon content of at least about 5 weight percent and said molybdenum compound is combined with said chargestock in an amount of at least about 10 ppm. by weight, calculated as elemental metal, based on the hydrocarbon chargestock.

6. The process of claim 4 wherein said molybdenum compound is combined with said chargestock in an amount in the range of about 10 ppm. to about 1000 ppm. by weight, calculated as elemental metal, based on the hydrocarbon chargestock.

7. The process of claim 5 wherein said molybdenum compound is combined with said chargestock in an amount in the range of about 10 ppm. to about 1000 ppm. by weight, calculated as elemental metal, based on the hydrocarbon chargestock.

8. The process of claim 1 wherein said peroxy compound is tertiary butyl hydroperoxide, said saturated alcohol is tertiary butyl alcohol, and said interaction takes place in the presence, additionally, of at least one primary alcohol containing from 1 to about 16 carbon atoms per molecule and having at least one primary hydroxy group present in an amount sufficient to enhance the solubility of molybdenum.

9. The process of claim 1 wherein said gas of step (b) is a hydrogen-containing gas.

10. The process of claim 1 wherein said gas of step (b) is a hydrogen sulfide-containing gas.

11. The process of claim 1 wherein said gas of step (b) is a gas comprising hydrogen and hydrogen sulfide.

12. The process of claim 1 wherein the product resulting from step (c) comprises a hydroconverted oil containing catalytic solids, the additional steps which comprise separating at least a portion of said catalytic solids from said hydroconverted oil and recycling at least a portion of said catalytic solids to step (a) or to step (c).

13. The process of claim 1 wherein said hydroconversion conditions include a temperature ranging from about 343° C. to about 538° C. (650° F. to 1000° F.) and a hydrogen partial pressure ranging from about 500 to about 5000 psig.

14. The process of claim 1 wherein said hydroconversion comprises hydrocracking.

15. The process of claim 5 wherein said hydroconversion comprises hydrocracking.

16. The process of claim 14 wherein said hydrocracking conditions include a temperature ranging from about 700° F., to 1000° F., and a total pressure ranging from about 500 to about 5000 psig.

17. The process of claim 15 wherein said hydrocracking conditions include a temperature ranging from about 700° F., to 1000° F., and a total pressure ranging from about 500 to about 5000 psig.

* * * * *

UNITED STATES PATENT AND TRADEMARK OFFICE

CERTIFICATE OF CORRECTION

PATENT NO. : 4,483,762

DATED : November 20, 1984

INVENTOR(S) : Martin P. Grosboll

It is certified that error appears in the above-identified patent and that said Letters Patent are hereby corrected as shown below:

Column 4, line 26, delete "residus" and insert in place thereof -- resids --.

Column 5, line 7, after "650°", delete "L".

Column 5, line 26, after "600°F. to about", insert -- 800°F. and at a pressure in the range from about 500 to about 5,000 psig. in the presence of a hydrogen-containing gas. Preferably the hydrogen-containing gas also comprises hydrogen sulfide. The hydrogen sulfide may preferably comprise about 1 to about 90 mole percent, more preferably about 2 to about 50 mole percent, still more preferably about 3 to about 30 --.

Column 7, line 46, after "hydrogen", insert -- under --.

Signed and Sealed this

*Thirtieth* Day of *April 1985*

[SEAL]

*Attest:*

DONALD J. QUIGG

*Attesting Officer* *Acting Commissioner of Patents and Trademarks*